United States Patent [19]

Reeves

[11] Patent Number: 4,523,886

[45] Date of Patent: Jun. 18, 1985

[54] CONTAINER HANDLER WITH PROGRAMMED ELECTRO-HYDRAULIC CONTROL CIRCUIT

[75] Inventor: Jerry L. Reeves, Dallas, Oreg.

[73] Assignee: Towmotor Corporation, Mentor, Ohio

[21] Appl. No.: 349,481

[22] PCT Filed: Jan. 13, 1982

[86] PCT No.: PCT/US82/00057

§ 371 Date: Jan. 13, 1982

§ 102(e) Date: Jan. 13, 1982

[87] PCT Pub. No.: WO83/02483

PCT Pub. Date: Jul. 21, 1983

[51] Int. Cl.[3] ..... F15B 11/20; B66F 9/22

[52] U.S. Cl. ..... 414/641; 91/521; 91/522; 91/526; 91/527; 91/531; 91/459; 414/667; 251/132; 137/596.17; 137/637.1

[58] Field of Search ..... 91/521, 522, 526, 527, 91/459, 523, 524, 529, 530, 531; 60/484; 414/641, 663, 667, 671; 294/81 SF; 137/596.17, 637.1; 361/165, 191; 251/132

[56] References Cited

U.S. PATENT DOCUMENTS

| | | | |
|---|---|---|---|
| 2,424,243 | 7/1947 | Lowell | 361/191 |
| 2,754,018 | 7/1956 | Schroeder | 214/652 |
| 3,354,789 | 11/1967 | Schenkelberger | 91/413 |
| 3,484,010 | 12/1969 | Campbell | 214/767 |
| 3,550,506 | 12/1970 | Gardenhour | 91/414 |
| 3,606,957 | 9/1971 | Fuzzell | 214/776 |
| 3,683,747 | 8/1972 | Petit | 91/530 |
| 3,703,931 | 11/1972 | Page et al. | 91/459 X |
| 3,752,346 | 8/1973 | Thompson et al. | 214/621 |
| 3,762,076 | 10/1973 | Eftefield | 91/459 X |
| 3,793,831 | 2/1974 | Khatti | 91/459 X |
| 3,795,280 | 3/1974 | Casey | 91/522 X |
| 3,897,805 | 8/1975 | Casey | 137/637 |
| 4,024,796 | 5/1977 | Theobald | 91/411 R |
| 4,086,843 | 5/1978 | Lorimor | 91/413 |
| 4,125,974 | 11/1978 | Kay et al. | 91/530 X |
| 4,165,674 | 8/1979 | Weigt | 91/178 |
| 4,185,541 | 1/1980 | Milberger et al. | 91/526 |
| 4,186,771 | 2/1980 | Matsumoto | 137/596.17 |
| 4,209,195 | 6/1980 | Holmes | 294/81.21 |
| 4,274,794 | 6/1981 | Olson | 414/663 |

FOREIGN PATENT DOCUMENTS

| | | |
|---|---|---|
| 1264334 | 3/1968 | Fed. Rep. of Germany . |
| 1507172 | 11/1969 | Fed. Rep. of Germany . |
| 1347758 | 2/1974 | United Kingdom . |
| 1468184 | 3/1977 | United Kingdom . |
| 2091908 | 8/1982 | United Kingdom . |

OTHER PUBLICATIONS

Brudi Equipment, Inc.-Form No. ECH 180. Reference AR—Discloses Conventional Container Handler.

*Primary Examiner*—Robert E. Garrett
*Assistant Examiner*—Richard S. Meyer
*Attorney, Agent, or Firm*—Phillips, Moore, Lempio & Finley

[57] ABSTRACT

Container handlers comprise a plurality of double-acting hydraulic cylinders to effect the various side shift, twist lock, tilt, height adjustment, and spread modes of operation. Separate control valves and hoses, entrained over the mast assembly having the attachment thereon, are required to effect such functions selectively. This invention is directed to a programmed electro-hydraulic control circuit when reduces the required number of hoses to two and provides a non-complex system which can be operated expeditiously. The control circuit comprises a main control valve and a master switch, each movable between first and second positions, first and second switches each movable between a closed position connecting a power source to the master switch and an open position disconnecting the power source from the master switch, and a plurality of solenoid-actuated control valves, each connected to the main control valve and to the master switch for actuation to preselected first or second positions thereof in concurrent response to the main control valve being in one of its first or second positions, the master switch being in one of its first or second positions, and a respective one of the first and second switches being in its closed position.

6 Claims, 5 Drawing Figures

FIG-5

| OPERATION | | MAIN VALVE -39- | | | SWITCHES | | | | | | SOLENOID OPERATED CONTROL VALVES | | | | | | | | |
|---|---|---|---|---|---|---|---|---|---|---|---|---|---|---|---|---|---|---|---|
| FUNCTION (CYLINDER) | CYLINDER POSITION | POSITION | | | MASTER -41- | | FIRST -42- | | SECOND -43- | | -44- | | | -45- | | | -46- | | |
| | | R | N | L | A | B | O | C | O | C | R | N | L | R | N | L | R | N | L |
| SIDE SHIFT -18- | EXT. | ● | | | ● | | ● | | | ● | | ● | | | ● | | | | ● |
| | RET. | | | ● | ● | | ● | | | ● | | ● | | | ● | | | | ● |
| TWIST LOCK -35,36- | EXT. | ● | | | ● | | | ● | ● | | ● | | | | ● | | | ● | |
| | RET. | | | ● | ● | | | ● | ● | | ● | | | | ● | | | ● | |
| TILT -29- | EXT. | | | ● | ● | | | ● | | ● | | ● | | | | ● | ● | | |
| | RET. | ● | | | ● | | | ● | | ● | | ● | | | | ● | ● | | |
| TILT -30- | EXT. | ● | | | ● | | | ● | | ● | | ● | | | | ● | ● | | |
| | RET. | | | ● | ● | | | ● | | ● | | ● | | | | ● | ● | | |
| HEIGHT -29,30- | EXT. | | | ● | | ● | ● | | | ● | | ● | | ● | | | | ● | |
| | RET. | ● | | | | ● | ● | | | ● | | ● | | ● | | | | ● | |
| SPREAD -31,32- | EXT. | ● | | | | ● | | ● | ● | | | | ● | | ● | | | ● | |
| | RET. | | | ● | | ● | | ● | ● | | | | ● | | ● | | | ● | |

CONTAINER HANDLER WITH PROGRAMMED ELECTRO-HYDRAULIC CONTROL CIRCUIT

DESCRIPTION

1. Technical Field

This invention relates generally to a programmed electro-hydraulic control circuit and more particularly to an electro-hydraulic control circuit for a container handler to selectively actuate a plurality of hydraulic cylinders thereof to effect the various container handling functions.

2. Background Art

The container handler attachment for a lift truck is adapted to pick-up, move, and deposit empty containers, having lengths up to forty feet, at desired locations for storage or filling purposes. The container handler attachment has a plurality of double-acting hydraulic cylinders mounted thereon to effect the various spread, side shift, side tilt, height adjustment, and twist lock functions whereby the container can be picked-up and transported even though it is disposed at various orientations relative to ground level. The hydraulic control system for selectively actuating the cylinders normally includes a separate directional control valve and attendant actuating lever for each handling function and separate hydraulic hoses for each control valve that are interconnected between the lift truck and the attachment.

This rather complicated control system thus necessitates substantial space on the vehicle and subjects the numerous hoses (e.g., ten) to potential damage since they must be entrained over the mast of the vehicle. In addition, the relatively large number of control valves required, e.g., seven, adds to the complexity of the control system and increases the potential for leakage and related failures in comparison to systems wherein a lesser number of control valves are required. Also, since the operator must manipulate the control levers for the valves individually, the container handling functions cannot be effected as expeditiously as desired.

The prior art has recognized the desirability of providing an electro-hydraulic control circuit wherein a solenoid-actuated directional control valve is placed on an attachment to reduce the number of hydraulic hoses required between the vehicle proper and the attachment. For example, U.S. Pat. No. 3,897,805, issued on Aug. 5, 1975 to Robert Casey and assigned to Caterpillar Tractor Co., broadly discloses this type of electro-hydraulic control circuit.

The present invention is directed to an improved electro-hydraulic control circuit which overcomes one or more of the problems as set forth above.

DISCLOSURE OF THE INVENTION

In one aspect of the present invention, a programmed electro-hydraulic circuit comprises a pressurized fluid source, a main control valve connected to the source, an electrical power source, a master switch connected to the power source, first and second switches, and a plurality of solenoid-actuated flow control valve means for actuation to preselected first or second positions thereof in concurrent response to the main control valve being in one of its first and second positions, the master switch being in one of its first and second positions, and a respective of the first and second switches being in its closed position.

In another aspect of this invention, the programmed electro-hydraulic control circuit controls the various functions of a container handler having a mast assembly, a carriage mounted for vertical movement on the mast assembly, and a container handling attachment. The container handling attachment includes a lower frame assembly slidably mounted on the carriage for transverse movement relative to the mast assembly, an upper frame assembly mounted for vertical and pivotal movement on the lower frame assembly, a pair of extensible beams mounted on opposite ends of the upper frame assembly, and a latch movably mounted on an end of each of the beams. A plurality of cylinders are controlled by the electro-hydraulic control circuit to selectively effect the various spread, side shift, side tilt, height adjustment, and twist lock functions of the container handler.

The electro-hydraulic control circuit of this invention will thus reduce the required number of control valves over conventional hydraulic control circuits (e.g., from seven to three), reduce the number of hydraulic hoses required to extend from the vehicle proper, over the mast, and to the container handler attachment (e.g., from ten to two), require substantially less space on the vehicle since the solenoid-actuated valves can be located on the container handler attachment, reduce the number of control levers required, and enable the operator to expeditiously actuate the control circuit to effect the various container handler functions.

BRIEF DESCRIPTION OF THE DRAWINGS

Other advantages and objects of this invention will become apparent from the following description and accompanying drawings wherein

FIG. 5 is a chart setting forth the various functions of the control circuit, including control valves and electrical switches thereof.

BEST MODE FOR CARRYING OUT THE INVENTION

GENERAL DESCRIPTION OF CONTAINER HANDLER ATTACHMENT 10

Figure 1:
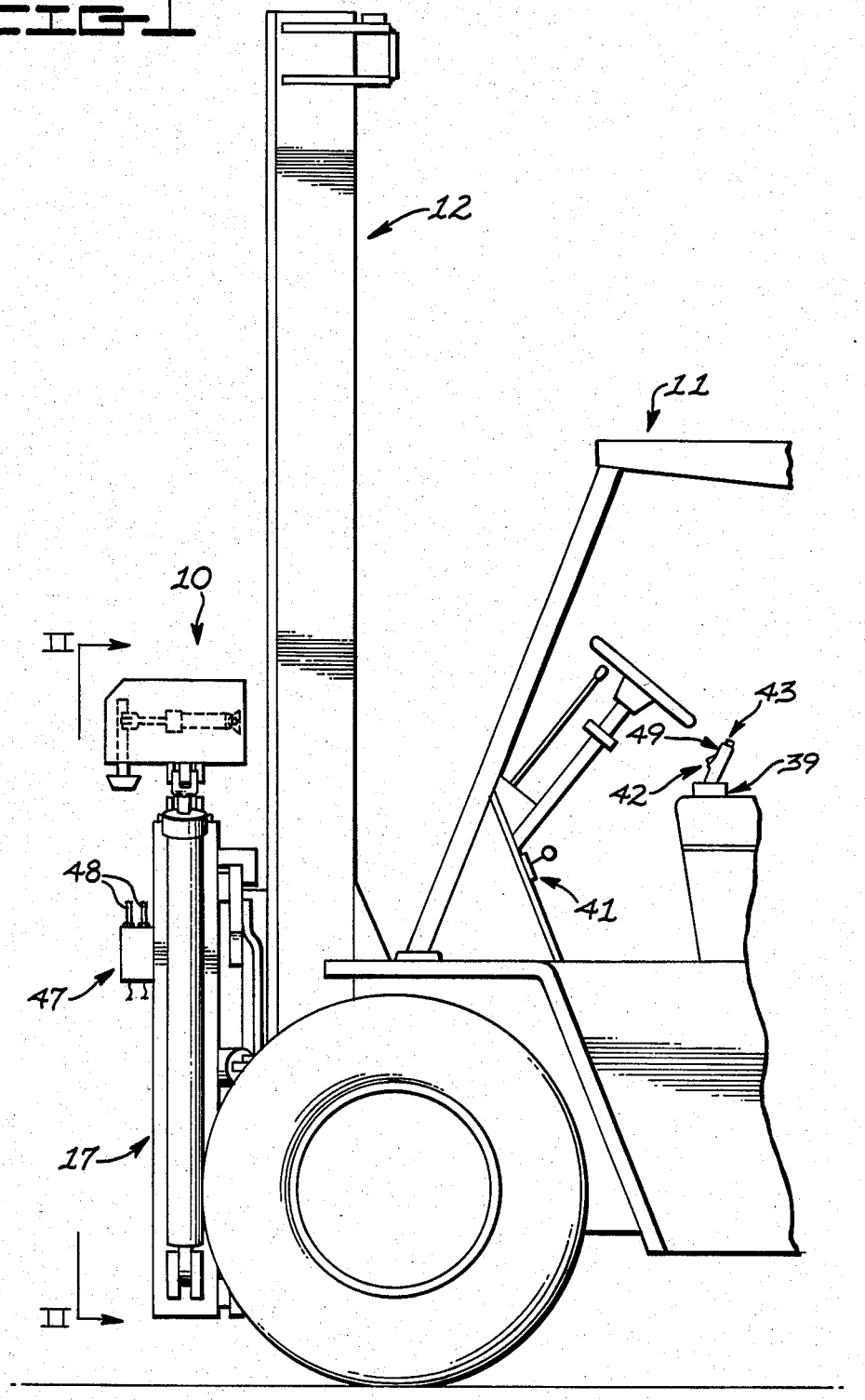
FIG. 1 is a partial side elevational view of a container handler comprising a lift truck having a container handler attachment mounted forwardly thereon.
Figure 2:
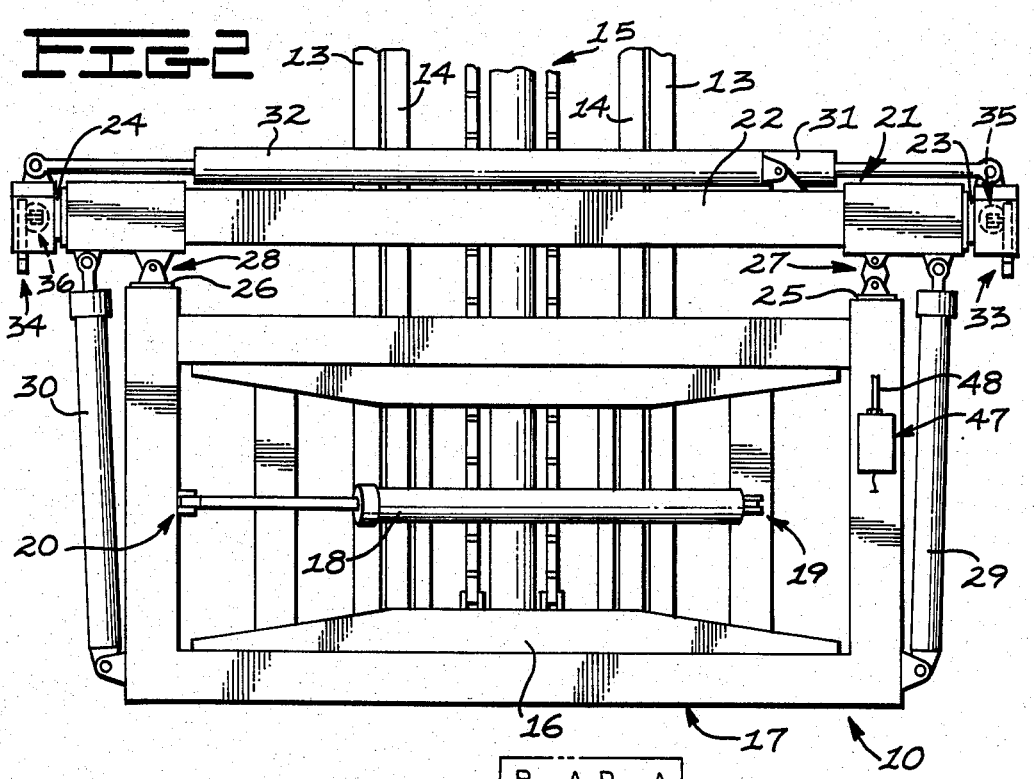
FIG. 2 is a front elevational view of the container handler attachment.

FIGS. 1 and 2 illustrate a container handler comprising a container handler attachment 10 mounted forwardly on a vehicle 11, shown in the form of a lift truck. The lift truck includes a conventional mast assembly 12 having a pair of fixed uprights 13 and a pair of movable uprights 14 mounted for vertical movement on the fixed uprights. The movable uprights are adapted to be selectively raised and lowered on the fixed uprights by a double-acting hydraulic lift cylinder and chain reeving arrangement 15 which also functions to move a carriage 16 on uprights 14 in a well-known manner.

Container handler attachment 10 comprises a rectangular lower frame assembly 17 slidably mounted on carriage 16 for transverse movements or side shifting thereon. Side shifting of the frame assembly is effected by a double-acting hydraulic cylinder 18 having its head end pivotally connected to carriage 17 at 19 and its rod end pivotally connected to frame assembly 17 at 20. Selective extension and retraction of cylinder 18 will thus effect transverse side shifting of the frame assembly on the carriage, as described more fully hereinafter.

Container handler attachment 10 further comprises an upper frame assembly 21 including a hollow beam 22 having extension members 23 and 24 telescopically mounted in each end thereof. A pair of extension members 25 and 26 are telescopically mounted in hollow upright legs of frame assembly 17 and are pivotally connected to beam 22 by a hinge connection 27 and a pivot connection 28, respectively.

Beam 22 is thus mounted for both vertical and pivotal movement on frame assembly 17 with such movements being effected by double-acting hydraulic lift and tilt cylinders 29 and 30, each pivotally interconnected between the beam and frame assembly. In particular, simultaneous extension or retraction of the cylinders will move opposite ends of the beam simultaneously for lifting purposes, whereas extension of one cylinder and retraction of the other cylinder will lift one end of the beam relative to the other end thereof, whereby the beam may be selectively placed in various orientations relative to ground level.

A pair of spread cylinders 31 and 32 are each pivotally interconnected between beam 22 and the exposed end of a respective extension member 23 or 24. Selective extension and retraction of cylinders 31 and 32 will thus extend or retract the members to accommodate the picking-up of containers of various lengths.

Standard latch mechanisms 33 and 34 are pivotally mounted on the ends of members 23 and 24, respectively, to engage a container to be lifted under control of latch cylinders 35 and 36, respectively. The latch mechanisms may either comprise the standard "twist-lock" or the standard "prong-type" latching mechanisms. Latch mechanisms of this type are disclosed in U.S. Pat. No. 3,752,346 issued on Aug. 14, 1973 to Norman D. Thompson, et al.

Since the above-described structures are well known in the art, further explanation thereof is deemed unnecessary for a full understanding and practicing of this invention.

DESCRIPTION OF ELECTRO-HYDRAULIC CONTROL CIRCUIT 37

Figure 3:
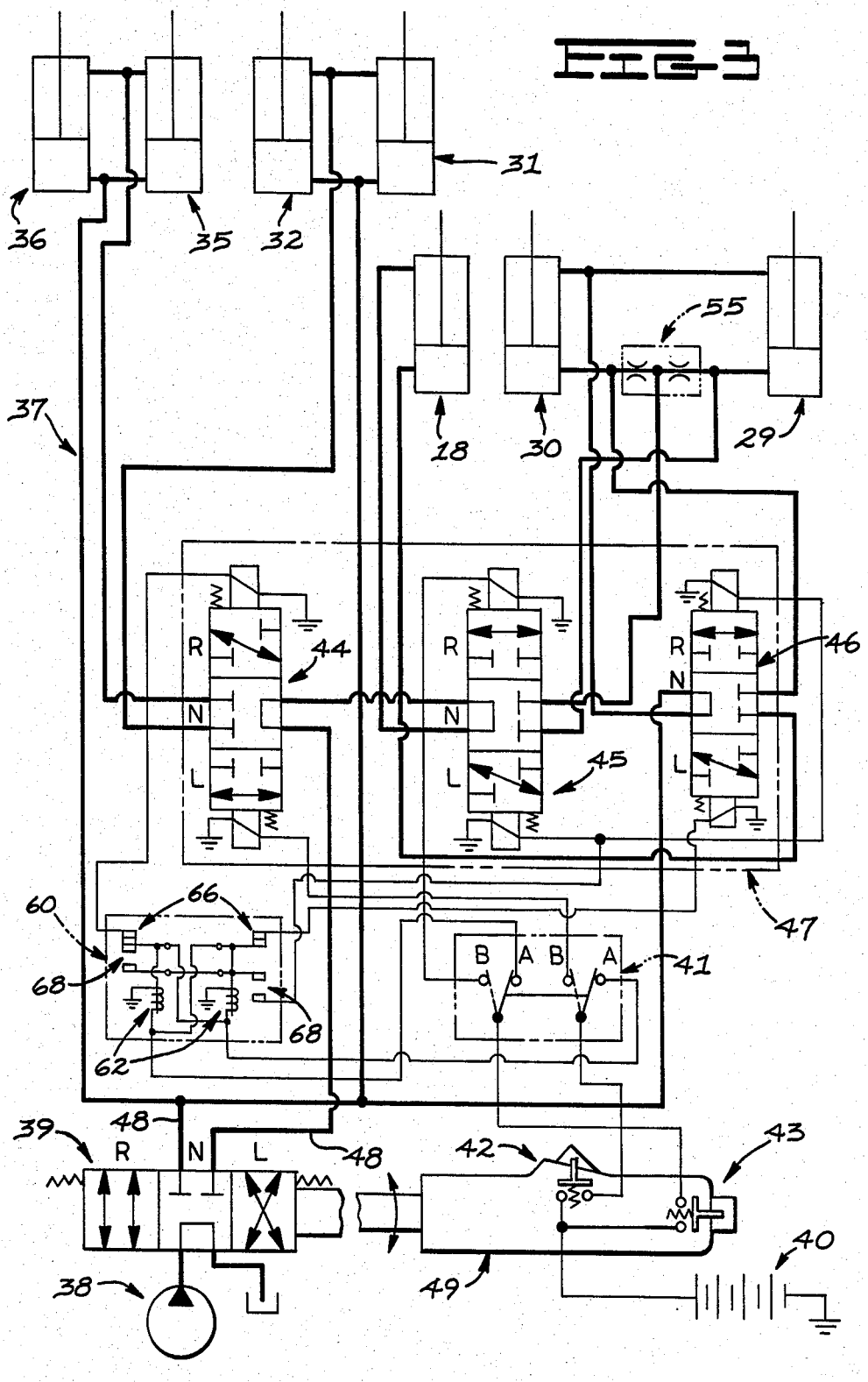
FIG. 3 schematically illustrates a programmed electro-hydraulic control circuit embodiment of the present invention for controlling the various functions of the container handler attachment.

FIG. 3 illustrates an electro-hydraulic control circuit 37 for selectively actuating cylinders 18, 29–32, 35, and 36. In the broadest aspect of this invention, the control circuit comprises a pressurized fluid source 38, a main control valve 39 connected to the fluid source and movable between first and second positions L and R (with an intermediate or neutral position N), an electrical power source 40, a master switch 41 connected to the power source and movable between first and second positions A and B, a relay 60 connected to the master switch 41 and first and second switches 42 and 43, each movable between a closed position connecting the power source to the master switch and an open position disconnecting the power source from the master switch.

In addition, the control circuit comprises a plurality of solenoid-actuated control valves 44, 45, and 46, each connected to the main control valve and to at least one of the relay 60 and master switch 41 for actuation to preselected first R or second L positions thereof in concurrent response to the main control valve being in one of its first or second positions, the master switch being in one of its first or second positions, and at least one of the first 42 or second 43 switches being in its closed position. Such concurrent positioning of the main control valve and switches will enable the operator to effect the desired combination of functions, i.e., side shifting via cylinder 18, tilt or height adjustment via cylinders 29 and 30, spreading via cylinders 31 and 32, and latching of the container onto the vehicle via cylinders 35 and 36.

Relay 60 has a pair of coils 62 and two pairs of normally closed 66 contacts and two pairs of normally open contacts 68. One of the normally closed pairs of contacts 66 passes electrical current to actuate solenoid operated valve 44 to first position R when switch 42 is closed and the master switch 41 is in position A. The other normally closed pair of contacts 66 passes electrical current to actuate solenoid operated valve 46 to second position L when the master switch 41 is in position A and switch 43 is closed. When both switches 42 and 43 are closed and the master switch is in position A, both pairs of normally open contacts 68 are moved to a closed position in response to the actuation of coils 62 which results in passing electrical current to shift valve 45 to second position L and valve 46 to first position R. It should be noted that the relay 60 connects the master switch 41, to pass electrical current, to selected ones of the solenoid operated control valves 44, 45, 46 only when the master switch is in position A and at least one of the first and second switches 42, 43 is in its closed position.

It should be noted in FIGS. 1–3 that solenoid-actuated directional control valves 44, 45, and 46 may be secured on frame assembly 17 of the container handler attachment as an integrated valve package 47. This arrangement facilitates the utilization of only two flexible hydraulic hoses or lines 48 and a wire harness interconnected between the valve package and main directional control valve 39 which is mounted in the operator's cab of the lift truck. The hoses are entrained over mast assembly 12 in a conventional manner to provide sufficient slack therein to enable the container handling attachment to undergo its various operations.

Referring to FIGS. 1 and 3, master switch 41 may be mounted on the dashboard of the operator's cab for ready access to the operator. Switches 42 and 43 are mounted on a control handle 49 which is also readily accessible to the operator. As schematically illustrated in FIG. 3, main directional control valve 39 is suitably connected to the handle to be actuated thereby (either reciprocated or rotated in a conventional manner) to its "R" or "L" operational position from its spring-biased centered or neutral position illustrated.

LATCHING RELAY CIRCUIT (FIG. 4)

Figure 4:
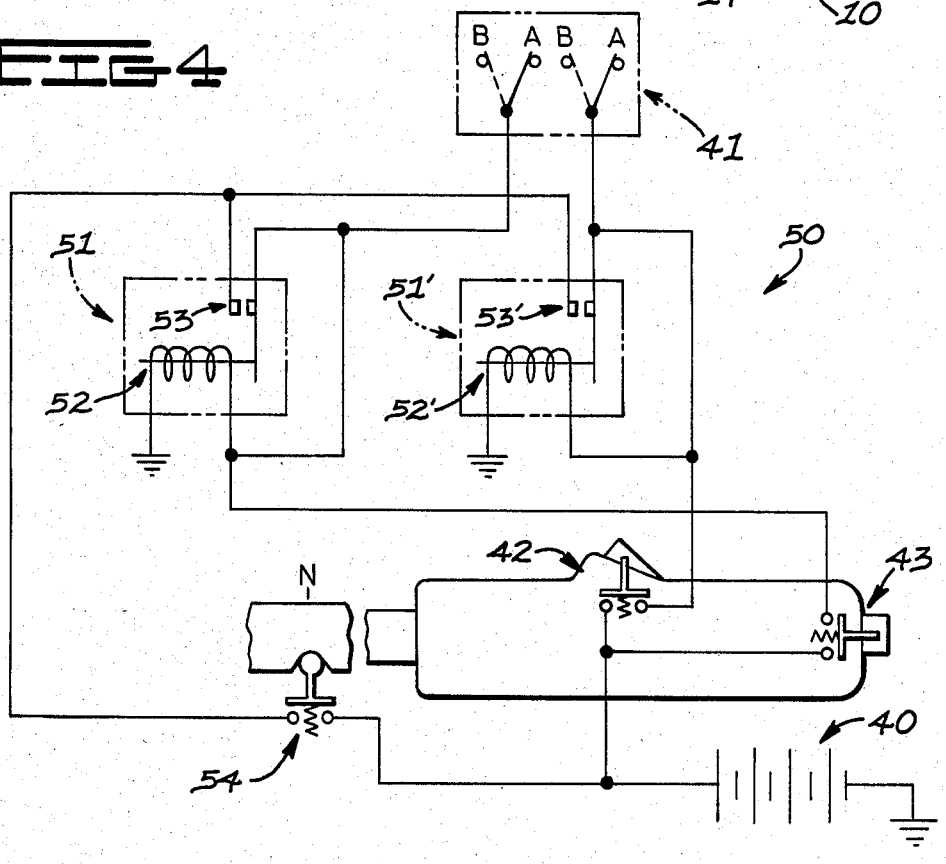
FIG. 4 schematically illustrates an electrical circuit of the latching relay type adapted for use with the control circuit of FIG. 3.

FIG. 4 illustrates a latching relay circuit 50 which may be integrated into electro-hydraulic control circuit 37 to ensure that the control circuit will be maintained in a selected mode of operation even though the operator may inadvertently release first or trigger switch 42 or second or pushbutton switch 43. The latching relay circuit comprises a pair of identical latching relays 51 and 51′ each including a solenoid 52 or 52′ and a relay contact 53 or 53′. When main directional control valve 39 is maintained in its neutral (N) position illustrated in FIGS. 3 and 4, a spring biased detent switch 54 will be maintained in its open position to prevent connection of battery 40 with master switch 41, through the latching relay circuit.

However, assuming shifting of directional control valve 39 to its "R" position, for example, detent switch 54 will close to connect battery 40 to the latching relay circuit. Further assuming the placing of master switch 41 in its "A" position and a closing of switch 43 to extend twist-lock cylinders 35 and 36, solenoid 52 will be energized to close relay contact 53. Further assuming that the operator inadvertently releases switch 43 to permit it to open, the twist-lock cylinders will remain in their extended, actuated conditions of operation since battery 40 will remain connected to master switch 41.

The locking function will continue until the operator again manually returns main directional control valve 39 to its "N" or neutral position of operation to deactivate the latching relay circuit, i.e., detent switch 54 will automatically reset to its open position illustrated in FIG. 4.

The latching relay circuit will thus ensure that the selection of a particular function of the container handler attachment will continue until the main directional control valve is returned to its neutral position. For example, in the absence of the latching relay circuit, placing of the main directional control valve in one of its "L" or "R" positions, depression and closing of one of the switches 42 or 43, and subsequent inadvertent release of the closed switch would actuate side shift cylinder 18 which could be disconcerting to the operator.

Industrial Applicability

Electro-hydraulic control circuit finds particular application to container handler attachment 10 to ensure selective and expeditious actuation of one or more cylinders 18, 29–32, 35, and 36. The circuit. also enables directional control valves 44, 45, and 46 to be mounted as valve package 47 on frame assembly 17 of the attachment. Thus, only two flexible hoses 48 and a wire harness need be entrained over mast assembly 12 in contrast to a conventional control circuit wherein ten such hoses are required along with seven corresponding directional control valves and attendant control levers mounted in the operator's cab. The single wire harness is utilized with control circuit 37 to interconnect the valve package with master switch 41, relay 60 and switches 42 and 43, mounted on single control handle 49 mounted in the operator's cab.

The various modes of operation of container handler attachment 10 and its associated electro-hydraulic control circuit 37 are illustrated in the chart of FIG. 5. As illustrated, side shift cylinder 18 is actuated to selectively position the attachment adjacent to a container to be picked-up by placing main directional control valve 39 in either its "L" or "R" position, placing the master switch 41 in position A and closing switch 43. For example, placing master switch 41 in position A and closing switch 43 will condition relay 60 to pass electrical current to shift solenoid valve 46 to position L. Movement of the control valve to its "R" position will communicate pump pressure to the head end of side shift cylinder 18 and simultaneously exhaust the rod end thereof sequentially through valves 45 and 44 to extend the cylinder to shift the container handler attachment leftwardly in FIG. 2.

When the attachment is properly positioned adjacent to the container to engage latch mechanisms 33 and 34 therewith, main direction control valve is moved to its "R" position, master switch 41 is placed in its "A" position and trigger switch 42 is depressed to its closed position to actuate relay 60 and thereby control valve 44 will move to its "R" position. Twist lock cylinders 35, 36 will thus extend to engage latch mechanisms 33 and 34, respectively, with the container.

When the operator desires to tilt upper frame assembly 21 on lower frame assembly 17, master switch 41 will be again positioned at "A" whereas switches 42 and 43 will be closed, as reflected in the chart of FIG. 5. As further indicated in the chart, the direction of tilt will be dictated by the positioning of main directional control valve 39 in either its "R" or "L" position to alternately extend and retract cylinders 29, 30. The depression and closing of trigger switch 42 and 43 will function to actuate relay 60 to direct current to valve 45 and 46 to move valve 45 to its "L" position and valve 46 to its "R" position to actuate cylinders 29 and 30 for both directions of tilt. A flow divider combiner valve 55 is interconnected between the cylinders and is further connected to valve 45 to prevent swapping of head end fluid between cylinders 29 and 30 and any abrupt extension or retraction of the cylinders during the tilt mode of operation.

One of the features of this invention is that placing of master switch 41 in position "A" will enable the operator to effect the twist lock, tilt and side shift functions, whereas the switch must be placed in position "B" to effect the height adjustment and spread functions. Thus, the operator need only be concerned with placing master switch 41 in either its "A" or "B" position, rotating handle 49 (FIG. 1) to place main directional control valve 39 in either its "R" or "L" position, and thereafter depressing switch 42 and 43, to effect the desired mode of operation of the attachment.

Referring once again to FIG. 5, the height adjustment of the attachment is affected by actuating cylinders 29, 30 simultaneously. As shown, master switch 41 is placed in its "B" position and switch 43 is closed with the extension or retraction of the cylinders being dictated by the "R" or "L" position of main directional control valve 39. Depression of button switch 43 will place control valve 45 in its "R" position without the aid of relay 60 for both extension and retraction of cylinders 29, 30.

Should the operator desire to spread upper frame assembly 21 by extending extension members 23 and 24 thereof, he will move main directional control valve 39 to its "R" position and master switch 41 to its "B" position. The operator is then enabled to depress and close trigger switch 42 whereby control valve 44 will be placed in its "L" position of operation without the aid of relay 60. Cylinders 31, 32 are thus extended to accommodate the container handler attachment to containers having various lengths. Conversely, the same switch pattern will be utilized to retract the cylinders, but with main directional control valve 39 being placed in its "L" position to retract the cylinders, as also reflected in the chart of FIG. 5.

Other aspects, objects, and advantages of this invention can be obtained from a study of the drawings, the description, and the appended claims.

I claim:

1. A programmed electro-hydraulic control circuit (37) comprising a pressurized fluid source (38);

a single main control valve (39) connected to said source (38) and movable between first (R) and second (L) positions;

an electrical power source (40);

a master switch (41) connected to said power source (40) and movable between first (A) and second (B) positions;

first (42) and second (43) switches each movable between a closed position connecting said power source (40) to said master switch (41) and an open position disconnecting said power source (4) from said master switch (41);

a plurality of solenoid-actuated control valve means (44,45,46), each connected to said main control valve (39) and to said master switch (41), and each actuatable to a preselected first (R) or second (L) position thereof in response to, said master switch (41) being in either one of its first (A) or second (B) positions, and at least one of said first (42) and second (43) switches being in its closed position, said main control valve (39) being further movable to a neutral position (N), between its first (R) and second (L) positions, preventing communication of said pressurized fluid source (38) to said control valve means (44,45,46) and wherein said control valve means (44,45,46) includes first (44), second (45) and third (46) control valve means each further movable to a neutral position (N) between the first (R) and second (L) positions thereof;

first cylinder means (18) for extending in response to positioning of said main control valve (39) being in its first position (R) and retracting in response to positioning of said main control valve (39) in its second position (L) with both such extension and retraction being in response to said master switch (41) being in its first (A) position, said first switch (42) being in its open position and said second switch (43) being in its closed position, each of said first (44) and second (45) control valve means being in its neutral position (N), and said third control valve means (46) being in its second position (L);

second cylinder means (35,36) for extending in response to said main control valve (39) being in its first position (R) and retracting in response to said main control valve (39) being in its second position (L) with both such extensions and retraction being in response to positioning of said master switch (41) in its first position (A), positioning of said first switch (42) in its closed position, positioning of said second switch (43) in its open position, positioning of said first control valve means (44) in its first position (R), positioning of said second control valve means (45) in its neutral position (N), and positioning of said third control valve means (46) in its neutral position (N); and a pair of third cylinder means (29,30) for alternately extending or retracting when said main control valve (39) is in its first (R) or second (L) position, respectively, with both such extension and retraction being in response to said master switch (41) being in its first position (A), said first switch (42) being in its closed position, said second switch (43) being in its closed position, said first control valve means (44) being in its neutral position (N), said second control valve means (45) being in its second position (L), and said third control valve means (46) being in its first position (R).

2. The control circuit of claim 1 wherein simultaneous extension or retraction of said pair of third cylinder means (29,30) is responsive to positioning of said master switch (41) in its second position (B), positioning of said first switch (42) in its open position, positioning of said second switch (43) in its closed position, positioning of said first control valve means (44) in its neutral position (N), positioning of said second control valve means (45) in its first position (R), and positioning of said third control valve means (46) in its neutral position (N).

3. The control circuit of claim 2 further including fourth cylinder means (31,32) for extending when said main control valve (39) is in its first position (R) and retracting when said main control valve (39) is in its second position (L), with both such extension and retraction being in response to said master switch (41) being in its second position (B), said first switch (42) being in its closed position, said second switch (43) being in its open position, said first control valve means (44) being in its second position (L), said second control valve means (45) being in its neutral position (N), and said third control valve means (46) being in its neutral position (N).

4. A programmed electro-hydraulic control circuit (37) in combination with a container handler (10,11) having a mast assembly (12), a carriage (16) mounted for vertical movement on said mast assembly (12), and a container handling attachment (10) including a lower frame assembly (17) slidably mounted for side shifting on said carriage (16), side shift cylinder means (18) for laterally shifting said lower frame assembly (17) on said carriage (16), an upper frame assembly (21) mounted for vertical and pivotal movement on said lower from assembly (17), a pair of lift and tilt cylinder means (29,30) for selectively lifting opposite ends of said upper frame assembly (21) simultaneously or for lifting one such end relative to the other end on said lower frame assembly (17), a pair of extensible members (23,24) slidably mounted on opposite ends of said upper frame assembly (21), spread cylinder means (31,32) for selectively extending said extensible members (23,24), a latch (33,34) movably mounted on the end of each of said extensible members (23,24), latch cylinder means (35,36) for moving each said latch (33,34) to lock a container on said carriage (16), said control circuit (37) including a pressurized fluid source (38), a main control valve (39) connected to said source (38) and movable between said first (R) and second (L) positions, an electrical power source (40), a master switch (41) connected to said power source (40) and movable between first (A) and second (B) positions, first (42) and second (43) switches each movable between a closed position connecting said power source (40) to said master switch (41) and an open position disconnecting said power source (40) from said master switch (41), and a plurality of solenoid-actuated control valve means (44, 45, 46) for selective actuation to first (R) and second (L) positions thereof in concurrent response to, said master switch (41) being in either one of its first (A) or second (B) positions, and at least one of said first (42) and second (43) switches being in its closed position, each of said control valve means (44,45,46) being connected to said main control valve (39) and to said master switch (41) and further connected to at least one of said cylinder means (18,29,=32,35,36) to control actuation thereof, said main control valve (39) being further movable to a neutral position (N), between its first (R) and second (L) positions, preventing communication of said pressurized fluid source (38) to said control valve means (44,45,46) and wherein said control valve means (44,45,46) includes first (44), second (45) and third (46) control valve means each further movable to a neutral position (N) between the first (R) and second (L) positions thereof, said side shift cylinder means (18) being responsive for extending in response to positioning of said main control valve (39) in its first position (R) and retracting in response to positioning of said main control valve (39) in its second position (L) with both such extension and retraction being in response to said master switch (41) being in its first (A) position, said first (42) switch being in its open position and said second switch (43) being in its closed position, each of said first (44) and second (45) control valve means being in its neutral position (N), and said third control valve means (46) being in its second position (L), each said latch cylinder means (35,36) being responsive for extending in response to said main control valve (39) being in its first position (R) and retracting in response to said main control valve (39) being in its second position (L) with both such extension and retraction being in response to positioning of said master switch (41) in its first position (A), positioning of said first switch (42) in its closed position, positioning of said second switch (43) in its open position, positioning of said first control valve means (44) in its first position (R), positioning of said second control valve means (45) in its neutral position (N), and positioning of said third control valve means (46) in its neutral position (N), and each of said lift and tilt cylinder means (29,30) being responsive for alternately extending or retracting when said main control valve (39) is in its first (R) or second (L) position, respectively, with both such extension and retraction being in response to said master switch (41) being in its first position (A), said first and second switches (42) being in their closed positions, said first control valve means (44) being in its neutral position (N), said second control valve means (45) being in its second position (L), and said third control valve means (46) being in its first position (R).

5. The combination of claim 4 wherein simultaneous extension or retraction of said pair of lift and tilt cylinder means (29,30) is responsive to positioning of said master switch (41) in its second position (B), positioning of said first switch (42) in its open position, positioning of said second switch (43) in its closed position, positioning of said first control valve means (44) in its neutral position (N), positioning of said second control valve means (45) in its first position (R), and positioning of said third control valve means (46) in its neutral position (N).

6. The combination of claim 5 wherein said spread cylinder means (31,32) is responsive for extending when said main control valve (39) is in its first position (R) and retracting when said main control valve (39) is in its second position (L) with both such extension and retraction being in response to said master switch (41) being in its second position (B), said first switch (42) being in its closed position, said second switch (43) being in its open position, said first control valve means (44) being in its second position (L), said second control valve means (45) being in its neutral position (N), and said third control valve means (46) being in its neutral position (N).

* * * * *